United States Patent [19]

Shikanai et al.

[11] Patent Number: 4,834,562

[45] Date of Patent: May 30, 1989

[54] PRINT CONTROL APPARATUS

[75] Inventors: Naoki Shikanai, Owariasahi; Tetsuo Okuhara, Seto; Koji Tanaka, Owariasahi, all of Japan

[73] Assignee: Hitachi, Ltd., Tokyo, Japan

[21] Appl. No.: 68,419

[22] Filed: Jul. 1, 1987

[30] Foreign Application Priority Data

Jul. 1, 1986 [JP] Japan ..... 61-154320

[51] Int. Cl.[4] ..... B41J 29/38

[52] U.S. Cl. ..... 400/54; 400/121; 400/322; 101/93.05

[58] Field of Search ..... 400/54, 121, 124, 320, 400/322, 323; 101/93.04, 93.05

[56] References Cited

U.S. PATENT DOCUMENTS 4,553,867 11/1983 Nakai ..... 400/54 X

FOREIGN PATENT DOCUMENTS 82386 6/1980 Japan ..... 400/322
4782 1/1982 Japan ..... 400/54
160657 10/1982 Japan ..... 400/54
134755 8/1983 Japan ..... 400/54
208069 12/1983 Japan ..... 400/54
16766 1/1984 Japan ..... 400/54
21265 2/1985 Japan ..... 400/322
120072 6/1985 Japan ..... 400/322
122184 6/1985 Japan ..... 400/54
157880 8/1985 Japan ..... 400/54
245559 12/1985 Japan ..... 400/54
8361 1/1986 Japan ..... 400/54
41560 2/1986 Japan ..... 400/54
143152 6/1986 Japan ..... 400/54
172773 8/1986 Japan ..... 400/54

*Primary Examiner*—Paul T. Sewell
*Attorney, Agent, or Firm*—Antonelli, Terry & Wands

[57] ABSTRACT

A print control apparatus for a dot printer such as serial printer or line printer comprises a print head having a plurality of dot elements, a drive mechanism for driving the dot elements and a control circuit for controlling the drive mechanism, and energized by a limited capacity of power supply. The apparatus comprises a circuit for detecting a dot drive voltage based on a difference between an idling power supply voltage and a power supply voltage in a print mode and/or a circuit for detecting the dot drive voltage, based on print data supplied from a print data source. An effective print speed is changed in accordance with the detected dot drive voltage.

9 Claims, 13 Drawing Sheets

PRINT CONTROL APPARATUS

BACKGROUND OF THE INVENTION

The present invention relates to print control technique, and more particularly to a print control apparatus suitable for graphic printing with a small power in a dot printer.

In a prior art apparatus disclosed in JP-A-60-120072 (Canon), when the total number of data elements in a line to be printed is larger than a predetermined number, one line is scanned more than once so that the temperature rise of the print head is kept constant and the power consumption per unit time is kept constant. In another prior art apparatus disclosed in JP-A-60-21265 (Oki Electric), the degree of drop of the drive voltage of the print head or dot printing elements is monitored by an electric circuit, and if the print head drive voltage drops below a predetermined level as a result of high density printing, the print operation is stopped, and after the drive voltage has been restored, the print head is back-spaced to resume printing from the interrupted position.

In the former serial printer, means for counting the total number of dots in one line (for example, 2448×24 dots) is required, and if it is implemented by an electrical circuit, the amount of hardware increases. When the dot counter is implemented by a program, the processing time increases because the number of dots must be counted for each line and hence the throughput is reduced. In the latter printer, the method is effective when the size of one block is regularly predetermined such as Kanji or a specific graphic pattern having, for example, 24×24 dots per block. However, the halting and/or resumption of printing is permitted only block by block. As the technique has been developed recently, many apparatus support a graphic function including painting. In graphic printing, unlike character block printing with a constant interval between adjacent characters, since the size of the block cannot be uniformly determined, when printing is resumed after interruption, a gap or overlap is created at a position where the printing is interrupted due to a backlash of the print mechanism, a rise characteristic of the motor and a backlash of the ink ribbon feed mechanism. As a result, the print quality is lowered.

SUMMARY OF THE INVENTION

It is an object of the present invention to provide a print control apparatus for a dot printer which allows high density printing such as graphic printing with a limited capacity of power supply without lowering the print quality, and which allows reduction of size of the apparatus.

It is another object of the present invention to provide a print control apparatus which allows high density printing with a limited capacity of power supply without requiring a large scale circuit and with a high throughput.

It is other object of the present invention to provide a print control apparatus which detects the print density of print data such as graphic pattern data whose print density is not identified by a control code, and determines a print speed in accordance with the detected print density so that the capacities of the power supply and the print head are fully utilized.

In accordance with one feature of the present invention, a dot printer includes a print head having a plurality of dot printing elements such as dot wires, thermal dots and ink jet nozzles, a drive mechanism for driving or energizing dot printing elements, a head scanning mechanism and a paper-feed mechanism and a control circuit for controlling those mechanisms, and this dot printer which is operated by a limited capacity of power supply, further comprises voltage drop detection means for detecting a drop of head drive voltage or dot drive voltage represented by a difference between an idling voltage of the power supply and a voltage occurring during a print operation, and print-speed (or print-rate) control means for changing the effective print rate in accordance with the voltage drop detected by the detection means. The voltage for energizing dot printing elements is referred to as a "dot drive voltage" hereunder.

By changing the effective print speed in accordance with the voltage drop detected by the voltage drop detection means such that the drive capability of the power supply is not exceeded, the degradation of the print quality in effecting high density printing by the dot printer with the limited capacity of power supply is prevented.

In accordance with another feature of the present invention, in order to achieve the second object, the print density detection means for the print data has a detection circuit for detecting dot drive voltage. During printing, the dot drive voltage is monitored for each dot position in a print range and print control is quickly switched in accordance with the detected voltage to change the effective print speed so that a lower limit of an allowable print head or dot drive voltage is not exceeded. A capacitor in an operational amplifier is used as the dot drive voltage detection circuit. It compares the dot drive voltage with a reference voltage to determine a level of the dot drive voltage. As the print density increases, the dot drive voltage gradually decreases, and when it falls below the predetermined level, the output of the comparator changes. The print control apparatus monitors the output of the comparator, and if there is a change, it immediately switches the control to lower the effective print speed to prevent the drive voltage from falling below the lower limit of the allowable dot drive voltage.

In one aspect of the present invention, even during low speed printing, the dot drive voltage is monitored by a second detection circuit (which is of the same construction as the first detection circuit with different reference voltage). As the print density decreases, the dot drive voltage gradually rises, and when it reaches a predetermined level, the output of the comparator changes. The print control apparatus monitors the output of the comparator, and when there is a change, it switches the print control to effect high speed printing. In order to prevent the first detection circuit from operating upon switching of the print control to the high speed printing, the reference voltage of the second detection circuit is set higher than the reference voltage of the first detection circuit.

In accordance with another feature of the present invention, the third object is achieved by dividing the print data into blocks, counting the number of dots for each block, comparing it with a threshold to determine the print density, and determining a print speed in accordance with the print density. In order to count the number of dots for each block, a parallel-in, serial-out shift register and respective counters for each of the blocks are provided. As print data is loaded into the shift register, data is read one bit (corresponding to one dot) for each clock. When the bit is "1", the counter is incremented. The count of the counter (i.e. the number of dots) is compared with the threshold by the comparator, which produces a signal to determine the print speed. Counters are selected by a selector which sequentially changes a counter select signal when the count of write pulses of the print data reaches the number of print data of the print blocks. Only the counter selected by the selector is incremented by the dot signal supplied from the shift register. In this manner, the print speed for each print block is determined.

DESCRIPTION OF THE PREFERRED EMBODIMENTS

Figure 1:
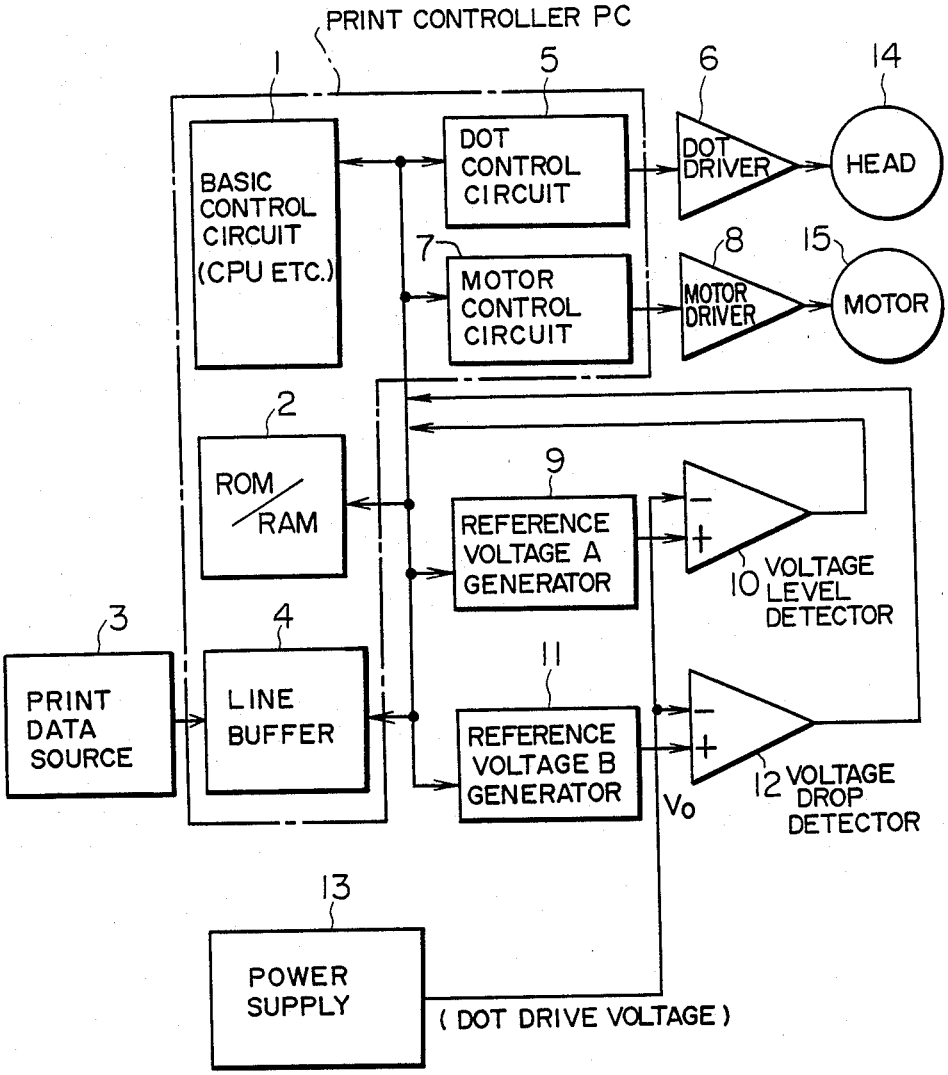
FIG. 1 shows a block diagram of one embodiment of a dot printer control apparatus.

A principle of the present invention is first explained.

In order to detect a drop of a power supply voltage, a voltage level in an idling mode is supplied to a comparator comprising an operational amplifier, and a reference voltage of a second comparator separately provided from the first comparator is set so as to correspond to the idling voltage level, so that the second comparator determines whether the drop of the dot drive voltage is larger than the predetermined level. When the voltage drop in the print operation exceeds the predetermined level, the following process is carried out by program means depending on whether the dot printer is a serial printer or a line printer. If it is the serial printer, the printing is stopped when the voltage drop exceeds the predetermined level. If the voltage drop thereafter decreases and the dot drive voltage is recovered, the print head is back-spaced on a line to be printed or print track by a predetermined amount, accelerated and restarts the printing from the print stopped position. The print speed is selected low enough to prevent the voltage drop detection circuit from operating even if all dots are driven. For example, when the capacity of the power supply allows printing of up to 50% duty factor, the print speed (print head carry velocity) is reduced to one half of the normal speed.

As a result, during the printing of that line, the voltage drop does not again exceed the predetermined level and the printing is completed. Accordingly, the degradation of the print quality is prevented. From the next line, the print speed is returned to the normal speed. In this manner, Kanji characters and symbols can be printed at a high speed, and for the graphic pattern whose print density per unit area (for example, 24×24 dots) exceeds 50%, the throughput is as low as that in the conventional apparatus but the print quality is not degraded. The resumption of the printing from the interrupted point position may be carried out in the following manner. The transport speed of the print head is the same as that for the normal printing, and the number of dots along a column to be simultaneously driven is limited to one half of all dots along the column (for example, 12 dots out of 24 dots). After one line has been printed, the print head is returned to the print resumption position, and the remaining half of the dots which were not driven in the first run are simultaneously driven, and the line is printed. In the line printer in which all dots are simultaneously driven, when the print voltage drop exceeds the predetermined level, the paper feed speed is lowered until the voltage recovers, that is, the drive period of the dots is expanded to reduce a load to the power supply. After the voltage has recovered, the paper feed speed is returned to the normal speed. In this manner, characters and symbols are printed at a high speed and graphic pattern is printed at a low speed, and high density printing is attained with a small capacity of power supply without degrading the print quality.

FIG. 1 shows a block diagram of one embodiment of the dot printer control apparatus of the present invention.

In FIG. 1, numeral 1 denotes a basic control circuit including a central processing unit, I/O ports and a timer, numeral 2 denotes ROM/RAM, numeral 3 denotes print data source for supplying print data, numeral 4 denotes a line buffer for temporarily storing print data line by line (for every predetermined number of lines in the line printer), numeral 5 denotes a head control circuit for controlling a print head 14 through a dot driver 6 for turning the dots on and off in accordance with the print data from the print data source 3, numeral 7 denotes the motor control circuit for controlling the drive of a head scan/sheet feed motor 15 through a motor driver 8, numeral 9 denotes a reference voltage A generator for generating a reference voltage A necessary to detect a level of the dot drive voltage in an idling mode, numeral 10 denotes an idling voltage level detection circuit, numeral 11 denotes a reference voltage B control circuit for generating a reference voltage B (shown by $V_o$ in FIG. 4) for detecting a voltage drop through the basic control circuit in accordance with the output of the detection circuit 10, numeral 12 denotes a voltage drop detection circuit for detecting a voltage drop of the dot drive voltage to the reference voltage B, numeral 13 denotes a power supply of a limited capacity with respect to drive capability for a maximum print density (for example, a portable small capacity battery), numeral 14 denotes a print head having a print dot array for printing print data on a predetermined sheet, and numeral 15 denotes a head scan/sheet feed motor for driving the print head of the serial printer or the sheet of the line printer. The circuits 1, 2, 4, 5 and 7 constitute a print controller PC. The head 14 may have a 24 (rows)×4 (columns) dot array for the serial printer.

Figure 2:
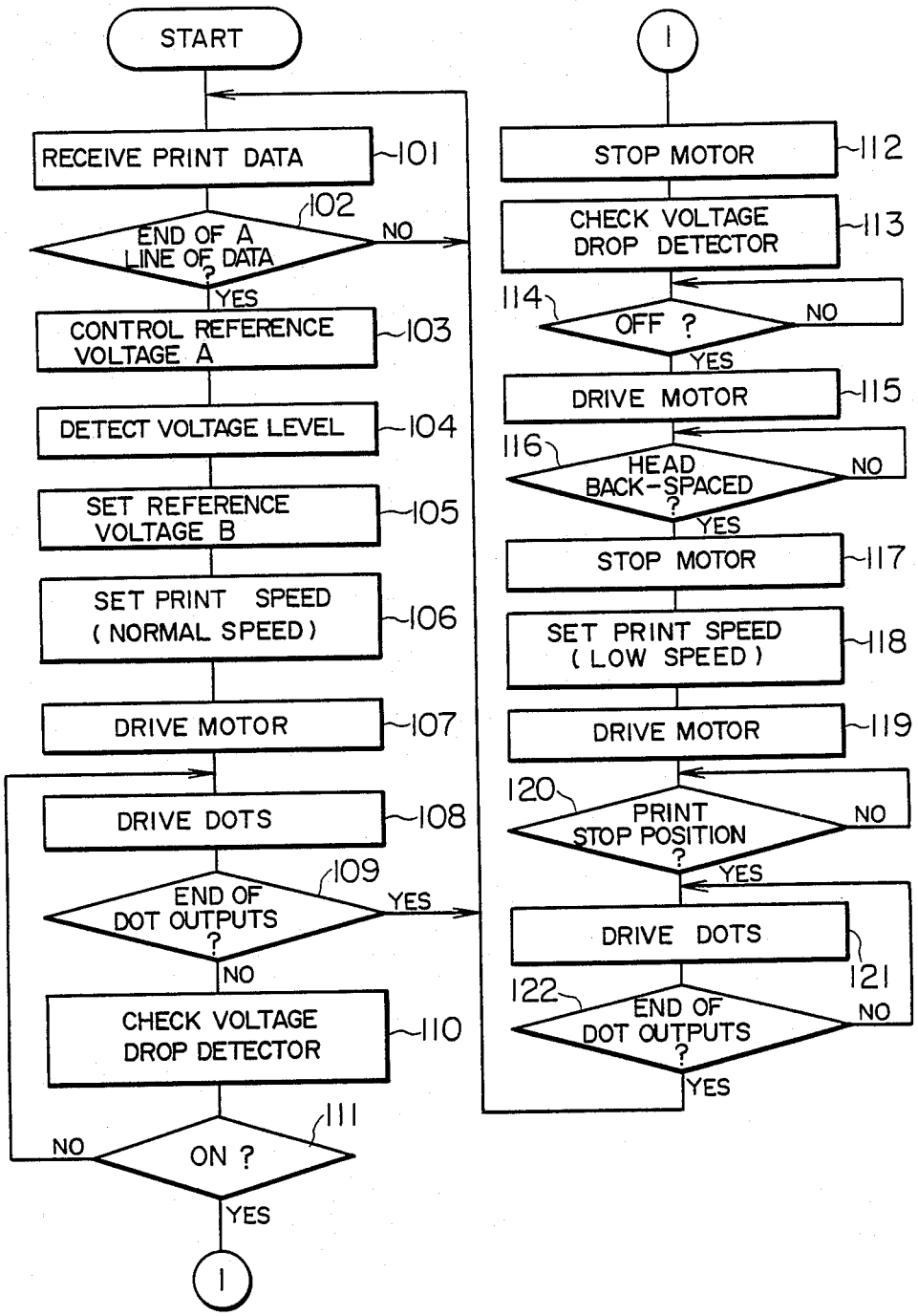
FIG. 2 shows a flow chart of a control program for changing a print speed in accordance with a voltage drop.

FIG. 2 shows an operation flow chart of the circuit of FIG. 1. For a sake of convenience, the operation of the present invention for use in a serial printer is explained with reference to the flow chart of FIG. 2.

The basic control circuit 1 reads the print data supplied from the print data source 3 into the line buffer 4 (step 101). After one line of print data has been read (step 102), the reference voltage A generator 9 is activated prior to the line-by-line printing. The reference voltage A of the voltage level detector 10 is changed in accordance with an instruction from the CPU of the basic control circuit 1 to detect the power supply voltage level in the idling mode, and the detection result is sent to the CPU in the form of a binary value (steps 103 and 104). This is necessary when a non-regulated power supply in which the dot drive voltage varies with a change of an AC input voltage is used, but it may be omitted when a regulated power supply in which the head (dot) drive voltage does not change with the change of the AC input voltage is used. The reference voltage B generator 11 is activated in accordance with the detected idling voltage level to set the reference voltage B (corresponding to Vo in FIG. 4) of the voltage drop detector 12 (step 105).

Then, the print speed is set to a normal speed (step 106), the motor 15 is driven (step 107), and when the print start portion is reached, the dot array in the head is driven (step 108). The dots are driven until a line of dot outputs are terminated (step 109), and whether the voltage drop detector 12 operates or not during the drive of dots is checked (step 110). When the voltage drop detector 12 produces an output (step 111), the head scan motor 15 is stopped (step 112), and after the output of the voltage drop detector 12 has been turned off by the recovery of the dot drive voltage (steps 113 and 114), the motor 15 is driven in the opposite direction to that in the print operation (step 115) to back-space the head by a predetermined amount (step 116). Then, the motor 15 is stopped (step 117), the print speed is set to a low speed (step 118), the motor 15 is driven in the print direction (step 119), and the drive of the dots is resumed from the interrupted print position (steps 120 and 121) and low speed printing is conducted until the dot outputs of that line are terminated (step 122). The step 122 may be used when an unscanned portion of the line is within a predetermined amount, and if it is beyond the predetermined amount, the print scan may be done at the high speed.

Figure 3:
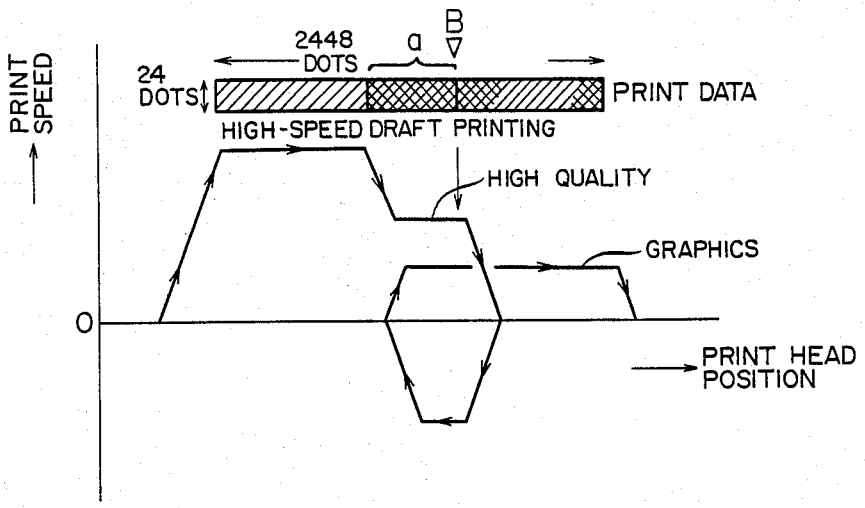
FIG. 3 shows line print data and corresponding head operation.
Figure 4:
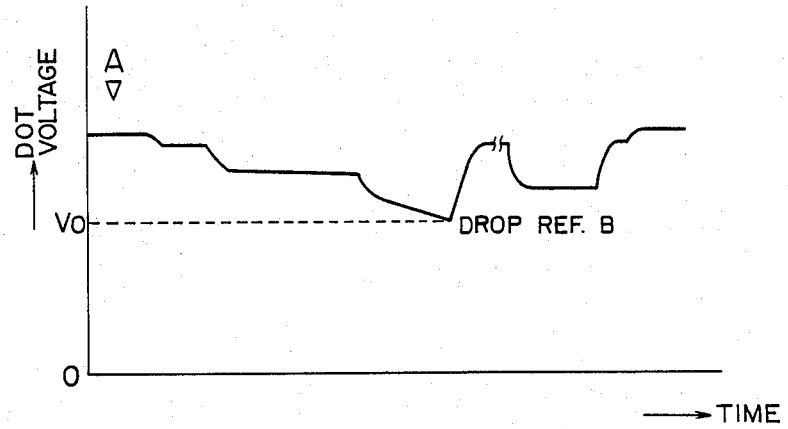
FIG. 4 shows a change of a dot drive voltage during printing.

FIG. 3 shows a relation between a line of print data and movement of the head, and FIG. 4 shows a change of the dot drive voltage during printing. By the printing of a high print density section a such as a painted pattern, the dot drive voltage falls below the reference voltage B and the output of the voltage drop detector 12 is turned on and an overload signal is detected. Thus, the head performs the stop, resumption and low speed print operations, as described above.

When the overload is detected, instead of immediately stopping the print head, the print speed may be gradually reduced when a circuit for detecting the increase of the print load detects a predetermine amount of increase.

In the present embodiment, in order to detect the print density, a program means is not used, but a hardware means including an electric circuit is used. Accordingly, the throughput of normal printing such as character printing is not lowered. For high density printing, a serial print operation is not carried out and hence the print quality is not degradated.

Figure 5:
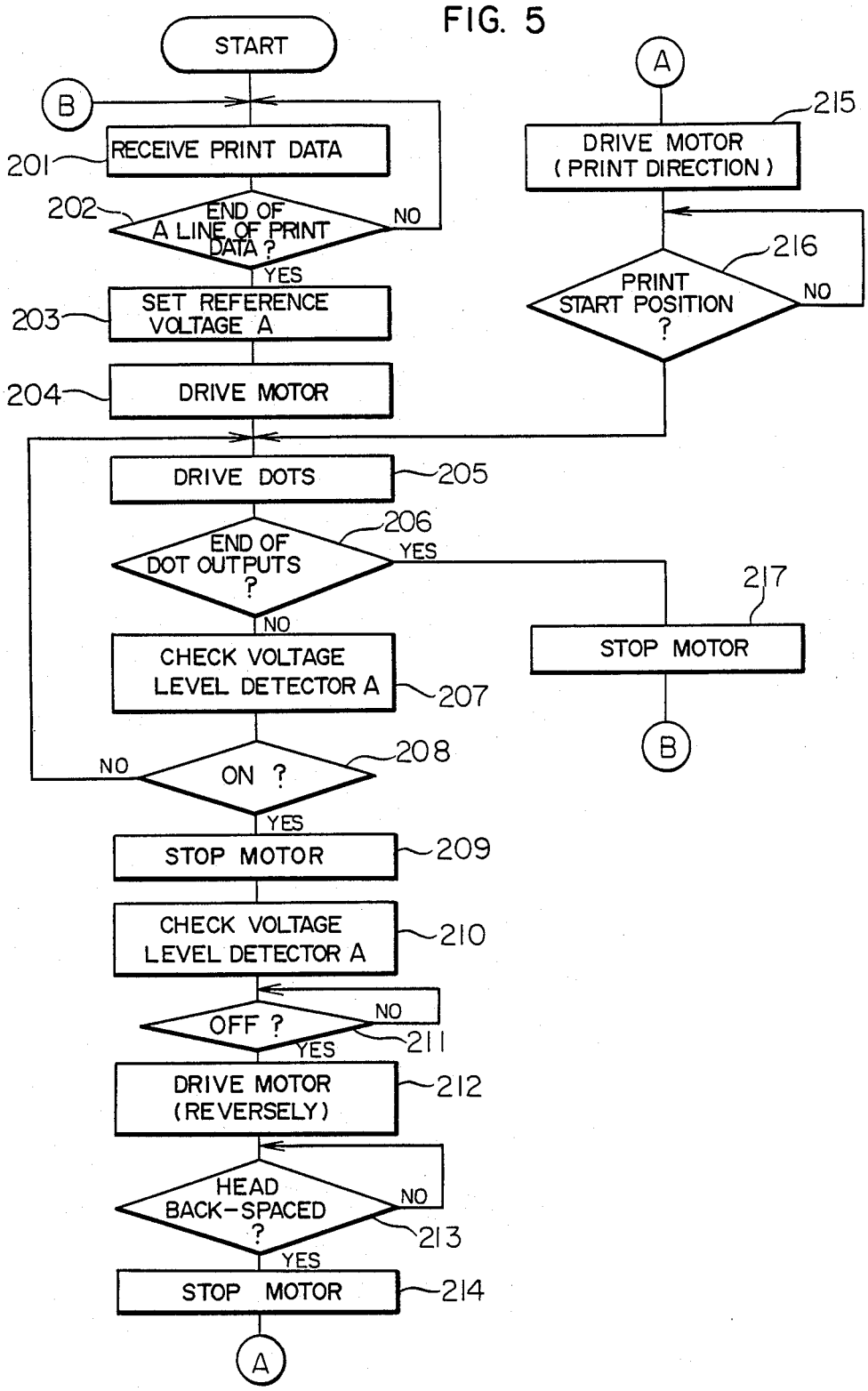
FIGS. 5 to 7 show print control flow charts for explaining other embodiments of the present invention.
Figure 6:
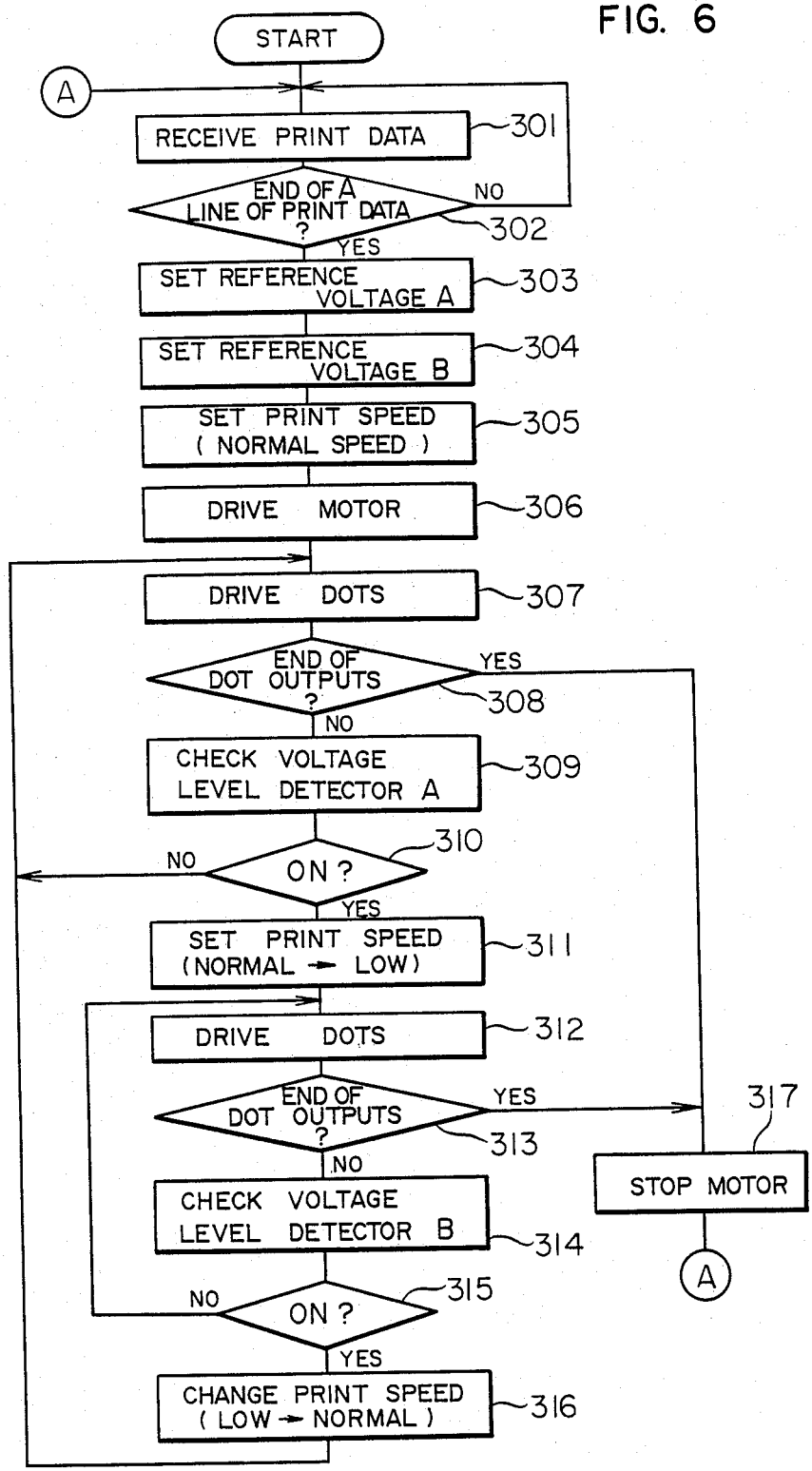
Figure 7:
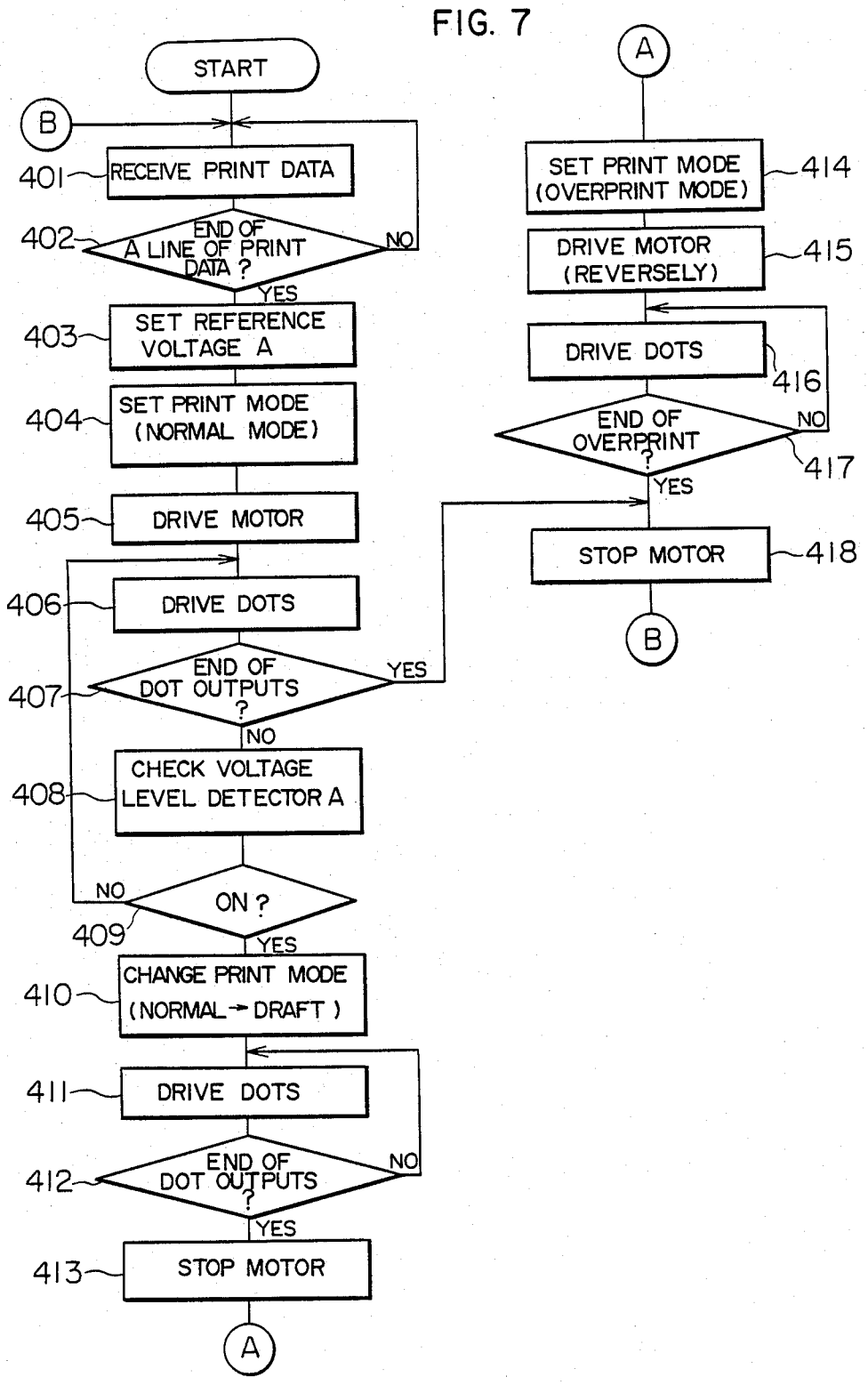
Figure 8A:
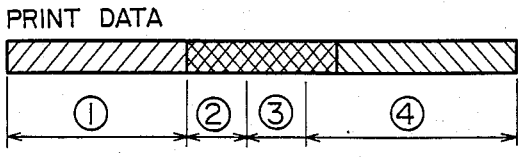
FIGS. 8A to 8C, 9A to 9C and 10A to 10C show charts similar to FIGS. 3 and 4 for explaining print operations of the embodiments of FIGS. 5 to 7, respectively.
Figure 8B:
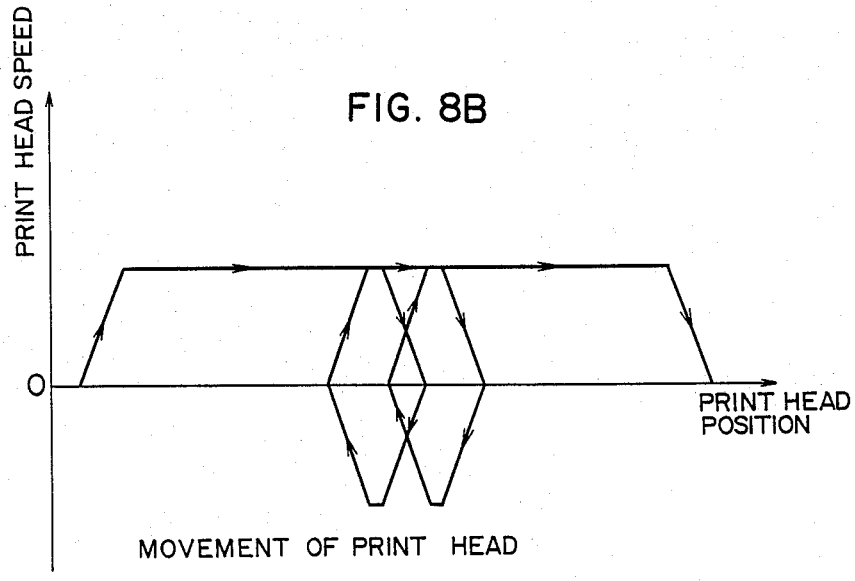
Figure 8C:
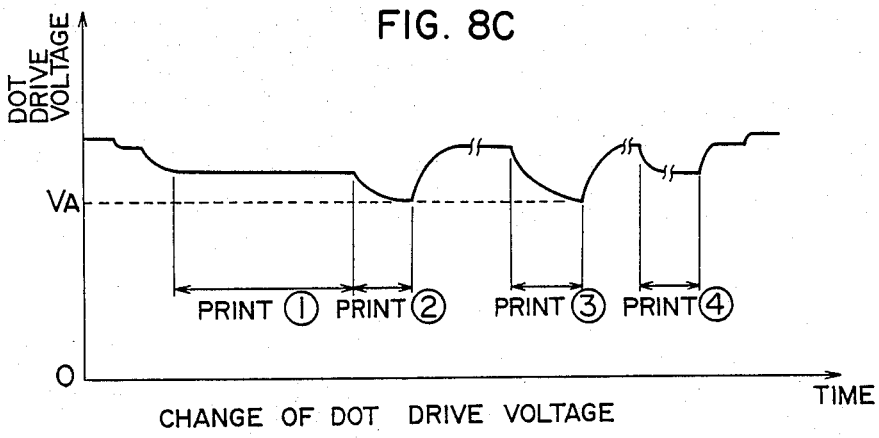

Referring to FIGS. 5 to 7, another embodiment of the print control of the present invention is explained. The hardware configuration is essentially same as that of FIG. 1 but the circuits 9 and 10 form a first detection circuit of the print dot drive voltage A, and the circuits 11 and 12 form a second detection circuit of the print dot drive voltage B.

The flow charts of FIGS. 5 to 7 show various operation modes of the print data and print head.

The print controller PC reads the print data supplied from the print data source 3 into the line buffer (step 201). After one line of print data has been read (step 202), the reference voltage A is set in accordance with the idling print dot drive voltage, if a non-regulated power supply is used (step 203) and the motor 15 is driven (step 204). At the print position, dots are driven (step 205) and the dots are driven until one line of dot outputs is terminated. During the drive of the dots, the output of the voltage level detector 10 is checked (steps 207 and 208), and if the output is turned on, the motor 15 is stopped (step 209) and the output of the voltage level detector 10 is again checked (steps 210 and 211). When the output is turned off, the motor 15 is driven in the opposite direction (step 212) to back-space the head by a predetermined amount, and then the motor is stopped (steps 213 and 214). The motor is again driven in the print direction, and when the head reaches the interrupted print position (steps 215 and 216), the dots are again driven. The steps 205 to 216 are repeated until one line of data has been printed, when the control returns to the step 201.

In the flow chart of FIG. 6, after the print data has been received (steps 301 and 302), reference voltages A and B are set (steps 303 and 304), the print speed is set to a normal speed and the motor is driven (steps 305 and 306). At the print position, the dots are driven until the print data has been printed (step 307). During the drive of the dots, the output of the voltage level detector 10 is checked (steps 309 and 310). When the output turns on, the print speed is gradually changed from the normal speed to the low speed (which is set such that the output of the detector 10 is turned off), and the dots are driven during the speed change and after the low speed is reached, until the dot outputs are terminated (steps 312 and 313). During the low speed printing, the output of the voltage level detector 12 is checked (steps 314 and 315). When the output is turned on, the print speed is changed from the low speed to the normal speed, and the step 307 et seq are repeated.

In the flow chart of FIG. 7, after one line of print data has been received, the reference voltage A is set (step 403), and the print mode is set to the normal mode (step 404). The motor is driven (step 405), and the dots are driven until the dot outputs are terminated (steps 406 and 407). During the drive of the dots, the output of the voltage level detector 10 is checked (steps 408 and 409). When the output is turned on, the print mode is changed from the normal mode to a draft mode (the print speed is not changed), and the dots are driven until the dot outputs are terminated (steps 410, 411 and 412). Then, the motor is stopped (step 413). Then, the print mode is set to an overprint mode, the motor is driven reversely (steps 414 and 415), and the dots omitted in the draft print mode are overprinted (steps 416 and 417). After the printing, the motor is stopped (step 418) and the process returns to the step 401.

Figure 9A:
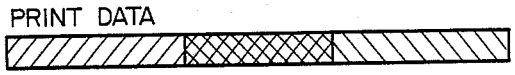
Figure 9B:
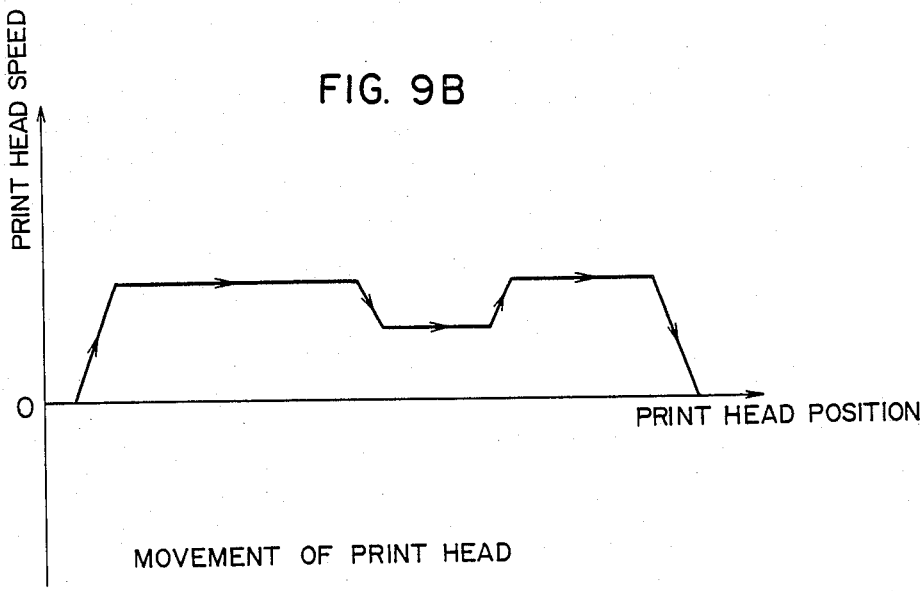
Figure 9C:
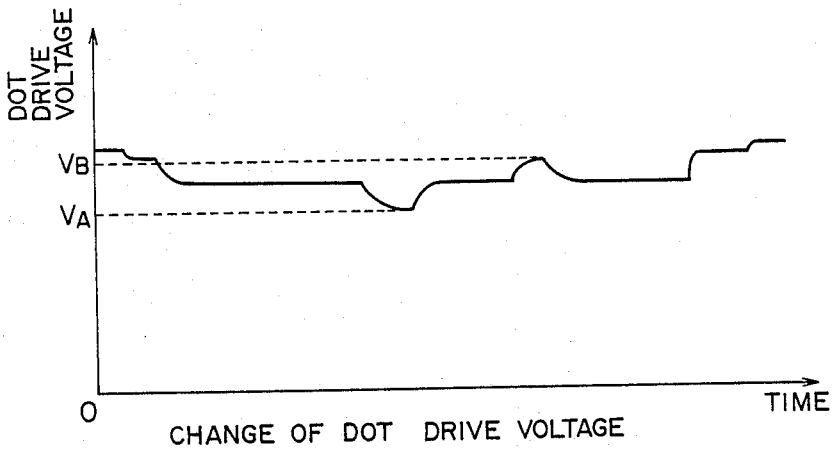
Figure 10A:
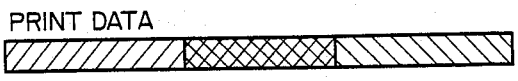
Figure 10B:
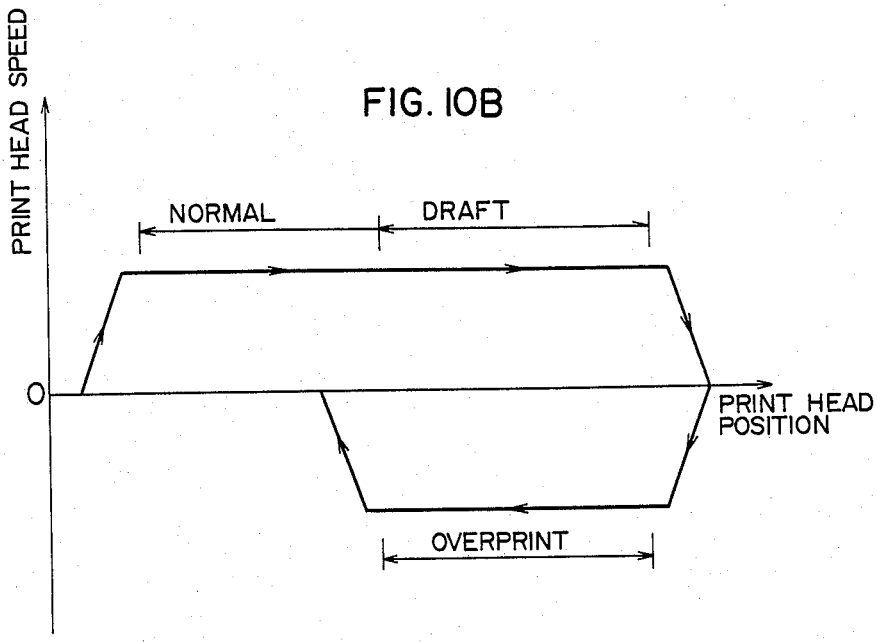
Figure 10C:
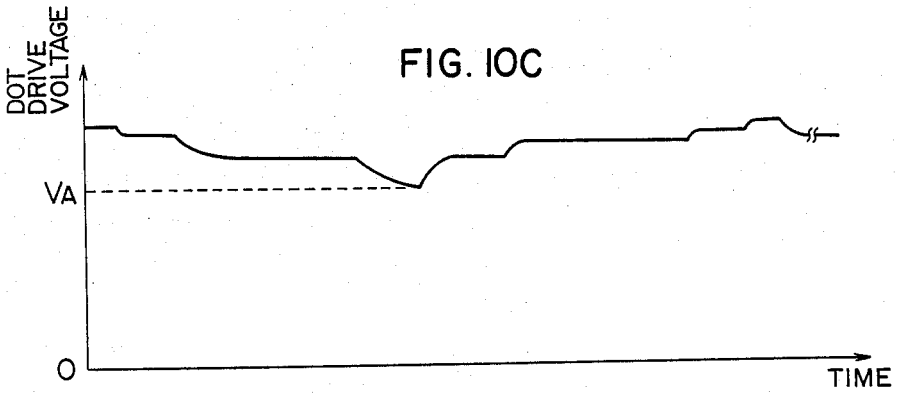

FIGS. 8A–8C, 9A–9C and 10A–10C show operations of the print head and changes of the dot drive voltage when the print control is effected in accordance with the flow charts of FIGS. 5, 6 and 7, respectively. Briefly, in FIGS. 8A–8C, in the printing of a high print density area, the print dot drive voltage reaches a detection level $V_A$ and a serial print operation is performed. In a low print density area, normal print operation is performed. In FIGS. 9A–9C, for a serial printer in the high print density area, when the dot drive voltage reaches the detection level $V_A$, the print speed is set to the low speed. When the print density lowers during low speed printing and the print dot drive voltage reaches a predetermined detection level $V_B$ higher than $V_A$, the print speed is again set to the high speed. In the case of a line printer, the ordinate indicates sheet feed speed and the abscissa indicates sheet position. In FIGS. 10A–10C, in the high print density area, when the print dot drive voltage reaches the detection level, the print mode is changed to the draft print mode, and after one line of print data has been printed, the omitted dots are overprinted in the reverse direction.

Figure 11:
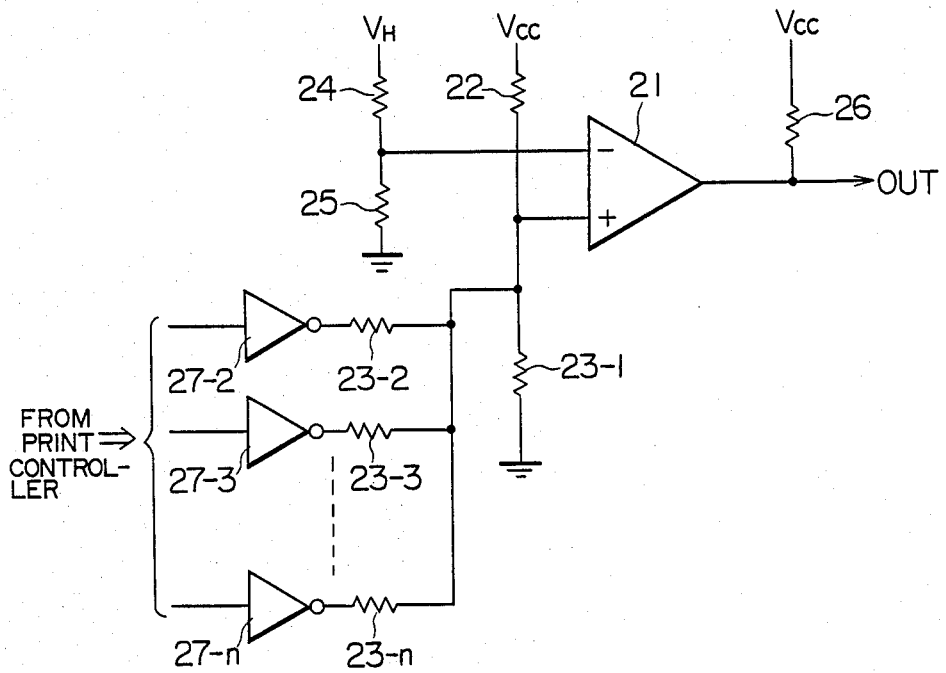
FIG. 11 shows a diagram of a voltage level detection circuit used in the present invention.

FIG. 11 shows a configuration of the voltage level detector 10. Numeral 21 denotes an operational amplifier. A reference voltage of a comparator is set by a power supply $V_{cc}$ of the control circuit, resistors 22, 23-1 to 23-n and open collector inverters 27-2 to 27-n, the print dot drive voltage $V_A$ is divided by resistors 24 and 25 and it is compared with the reference voltage.

Figure 12:
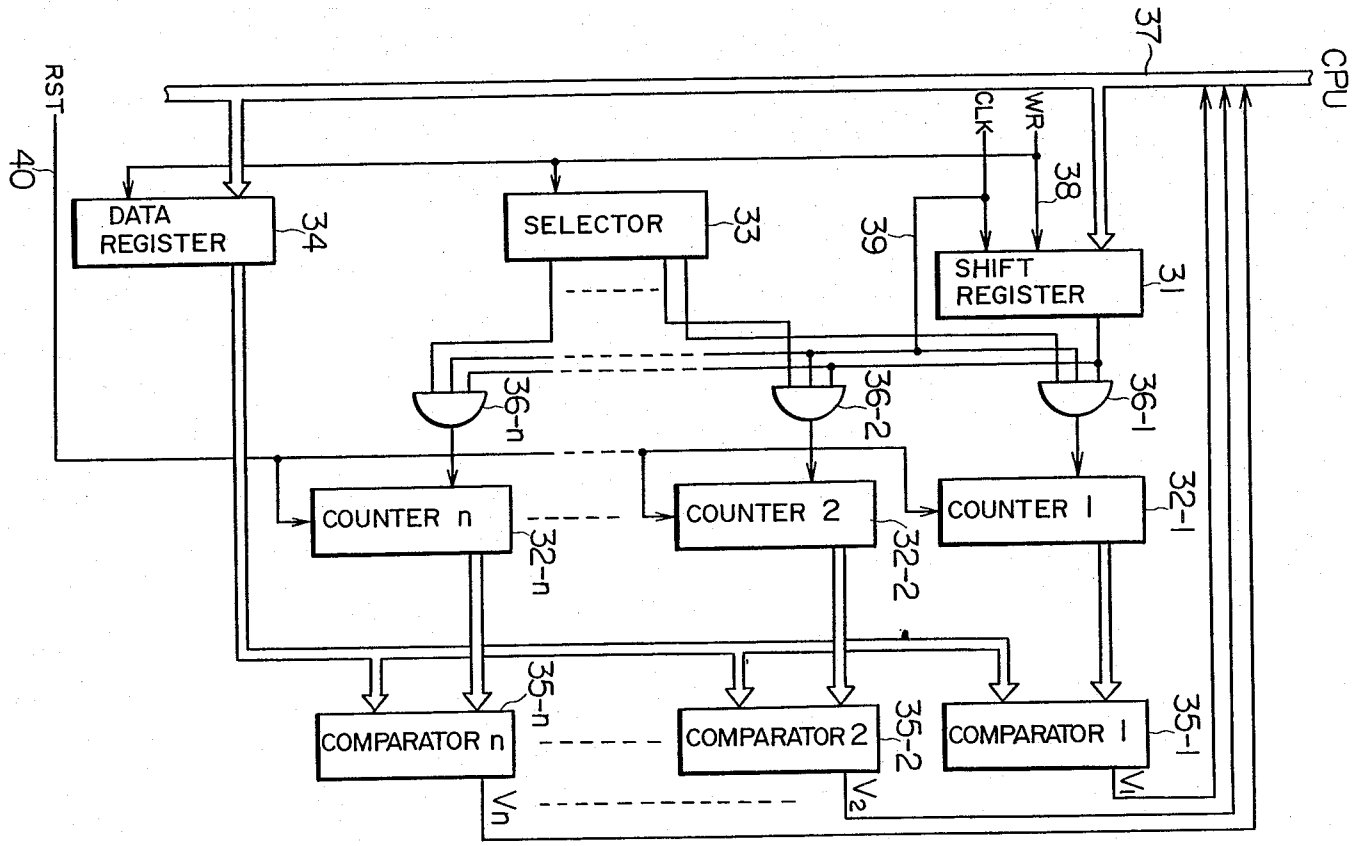
FIG. 12 shows a block diagram of an embodiment of the present invention.
Figure 13A:
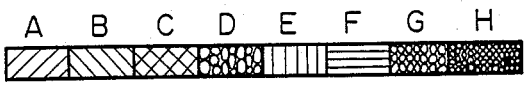
FIGS. 13A and 13B illustrate print operations.
Figure 13B:
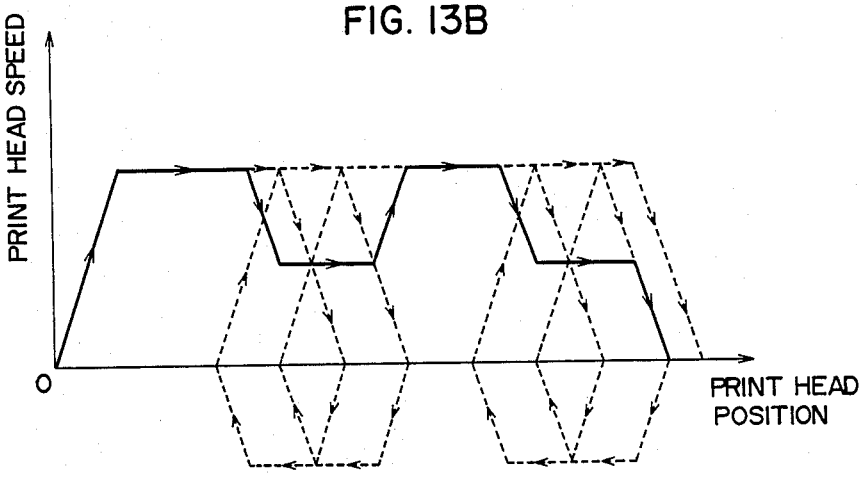
Figure 13C:
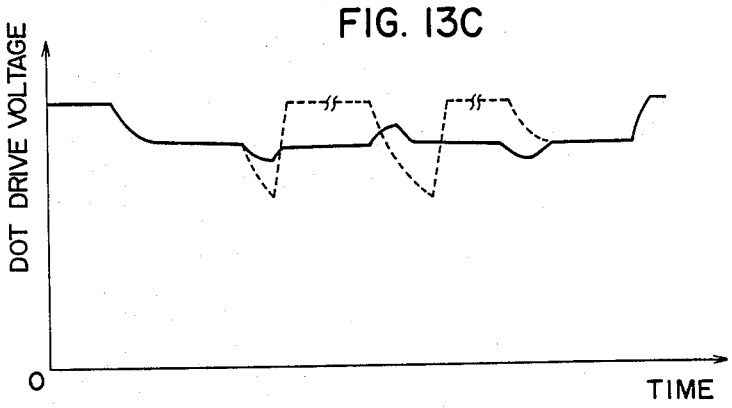
FIG. 13C shows a change of a print head drive voltage.

Another embodiment of the present invention is explained with reference to FIGS. 12 and 13A–13C. A shift register 31 is connected to a bus 37 of a CPU (not shown) and the print data is parallelly inputted by a write pulse 38. The shift register 31 serially outputs the loaded print data by a clock 39, and when the data is "1", a counter (one of 32-1 to 32-n) is incremented at the timing of the clock through an AND gate (one of 36-1 to 36-n) selected by a selector 33 (when output of the selector is "1"). After the print data has been written into the shift register 31 by the write pulse by a predetermined number of times, the selector 33 which counts the number of times switches the select signal for the counters 32-1 to 32-n. Thus, from the next print data, the other counter is incremented. After the number of dots of all print data has been counted, the counts in the counters 32-1 to 32-n and present threshold data stored in the data register 34 are compared by comparators 35-1 to 35-n, which produces signals $V_1$–$V_n$ representing the print speed of the blocks. A print controller (not shown) reads the print speed signals $V_1$–$V_n$ and sets the print velocities for the blocks. FIGS. 13A and 13B show a print density chart and a print operation in the present embodiment, and FIG. 13C shows a change of the dot drive voltage. One line of print data is divided into blocks A–H. In low print density blocks A, B, E and F, high speed printing is effected, and in high print density blocks C, D, G and H, low speed printing is effected.

In this manner, for the high print density printing, the drop of the dot drive voltage is suppressed and the graphic printing is effected with a high throughput and a small and low capacity power supply without degrading the print quality. For a comparison purpose, charts for the prior art apparatus disclosed in JP-A-60-21265 are shown by broken lines in FIGS. 13B and 13C.

Figure 14A:
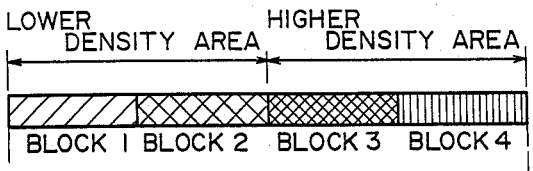
FIG. 14A to 14C show diagrams for explaining a further embodiments of the present invention.
Figure 14B:
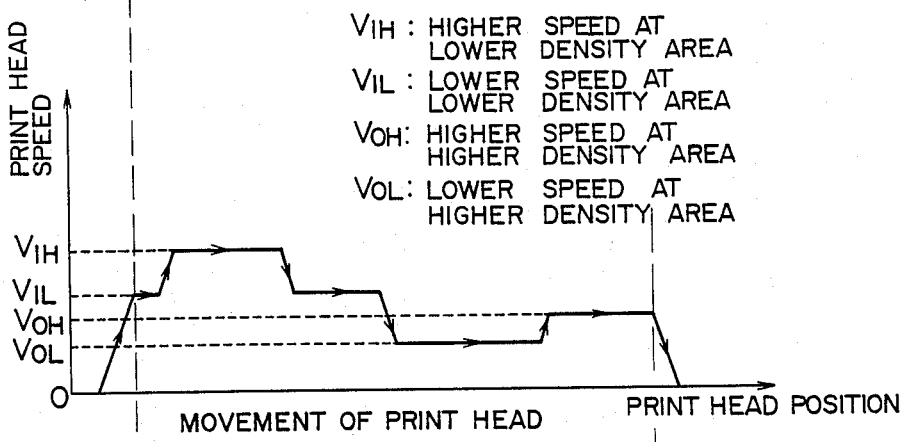
Figure 14C:
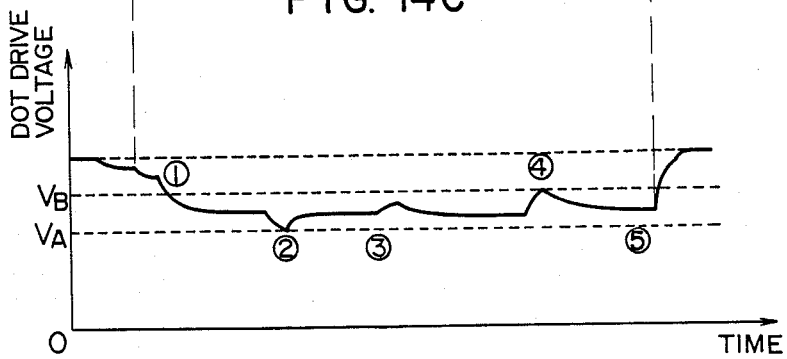

In FIGS. 14A to 14C like FIGS. 13A to 13C, another embodiment of the present invention is illustrated in which a dot printing control is performed based on a combination of the detection result of the number of data to be driven from a print data source and the detection result of the dot drive voltage drop. The print speed may be changed in a coarse step depending on the output of a dot counter circuit for counting dots from the print data source as shown in FIG. 12 and then be changed in a fine step depending on the output of a voltage drop detector as shown in FIG. 1 for detecting the current dot drive voltage of the printer.

FIG. 14A illustrates an example of a pattern of print density areas for one line having four divided blocks 1 to 4. In accordance with the outputs from the dot counter circuit the blocks 1 and 2 are determined as lower density printing blocks and the blocks 3 and 4 are determined as higher density printing blocks, respectively. FIG. 14B indicates a relation between the print head speed and the print head position, in one-line serial printing under control of the print controller PC as shown in FIG. 1, in which $v_{1H}$ represents a higher speed at the lower print density area, $v_{1L}$ represents a lower speed at the lower print density area, $v_{0H}$ represents a higher speed at the higher print density area and $v_{0L}$ represents a lower speed at the higher print density area.

FIG. 14C illustrates an example of a variation in the dot drive voltage detected by the voltage drop detector in a printing operation for the dot data shown in FIG. 14A. The actual print speed is variably determined based on the detected dot count result and the detected dot drive voltage such that; ① the dot drive voltage is larger than the allowable threshold level $V_A$ when the print head speed is equal to $v_{1L}$; ② the dot drive voltage is smaller than the threshold level $V_A$ when the head speed is equal to $v_{1H}$; ③ the next printing block becomes a higher density area when the head speed is equal to $v_{1L}$ or $v_{1H}$, or it becomes a lower density area when the head speed is equal to $v_{0H}$; ④ the dot drive voltage is larger than the resumptions threshold level $V_B$ when the head speed is equal to $v_{0L}$; and ⑤ the dot drive voltage becomes smaller than $V_B$ when the head speed is equal to $v_{0H}$.

We claim:

1. A print control apparatus for a dot serial printer including a print head having a plurality of dot elements, a dot drive circuit for selectively driving the dot elements of said print head in accordance with print data, a motor for moving said print head with respect to a printing medium along successive lines in a printing direction, a motor drive circuit for driving said motor, and a control circuit for controlling said dot drive circuit and said motor drive circuit, said dot elements, said motor and said control circuit being energized by a power supply having a limited current capacity, comprising:

first voltage detection means for detecting the level of a voltage supplied from said power supply for driving the dot elements prior to each time printing is started for each line;

second voltage detection means, responsive to said first voltage detection means, for variably setting a first voltage detection reference value based on a dot drive voltage detected by said first voltage detection means prior to printing of each line and for detecting the level of a voltage driving the dot elements during printing;

said control circuit including means responsive to said first and second voltage detection means for controlling the motor drive circuit such that (1) said head is moved at a normal speed equal to an upper-limit head speed at the start of printing, (2) the movement of said head is interrupted when a predetermined drop in the level of the dot element drive voltage is detected by said second voltage detection means with respect to said first voltage detection reference value, and (3) after interruption, the movement of said head is resumed for any remainder of the line on the printing medium at a low speed lower than said normal speed as determined by an upper-limit speed at full-dot printing, when the dot drive voltage has recovered to a predetermined voltage at which the voltage drop is smaller than said predetermined drop.

2. A dot serial printer control apparatus according to claim 1, wherein said control circuit includes change means responsive to the output of said second voltage detection means for controlling the motor drive circuit such that said head speed changes from the low speed to the normal speed when said second detection means detects a first predetermined voltage detection level higher than a second voltage detection level at which said predetermined dot element drive voltage drop arises, after the movement of the head has been changed from normal speed to low speed.

3. A print control apparatus for a dot serial printer according to claim 2, further comprising means for receiving print data to be printed on each printing line from a print data source; block division means for dividing print data for one line from said receiving means into a plurality of blocks; count means for counting print data in each block to detect the number of dot elements to be driven; print speed determination means for comparing a count result of said count means with at least one predetermined threshold to determine the print speed for each block; said first and second voltage detection means including means for detecting first and second thresholds for the dot drive voltage representing an allowable threshold and a resumption threshold, respectively; and said control means controlling the motor drive circuit such that the print speed determined by said print speed determination means is varied depending on the detection results from said first and second detection means for each block.

4. A print control apparatus according to claim 3, wherein said dot drive voltage detection means includes a dot column drive voltage detection circuit for detecting a dot drive voltage for each of a plurality of dot elements columns, and said print speed determination means includes a circuit for changing the print speed when the output of said dot element column drive voltage detection circuit falls below a predetermined level.

5. A print control apparatus according to claim 4, wherein said print speed change circuit includes means for switching the print speed to a low speed equal to an upper-limit speed at full-dot printing depending on the limited current capacity when the dot drive voltage is below the predetermined level, and if the dot drive voltage recovers to the predetermined level in a predetermined period, switches the print speed to a high speed equal to an upper-limit speed of print head and changes the print speed for each line.

6. A print control apparatus according to claim 4, wherein said print speed change circuit switches the print mode to a draft mode in which less than all dots are printed when the dot drive voltage falls below the predetermined level, and after the remaining portion of that line has been printed, switches the print mode to an overprint mode to overprint any omitted dots.

7. A print control apparatus for a dot line printer including a print head having a plurality of dot elements, a dot drive circuit for selectively driving the dot elements of said print head in accordance with print data, a motor for effecting feeding movement of a printing medium for line printing, a motor drive circuit for driving the motor, and a control circuit for controlling said dot drive circuit and said motor drive circuit, and at least said dot elements, said motor and said control circuit being energized by a power supply having a limited current capacity, comprising:

first detection means for detecting a first dot drive voltage at which a printing speed is changed from a low-feed speed of printing medium to a normal-feed speed higher than said low-feed speed;

second detection means for detecting a second dot drive voltage, lower than said first dot drive voltage, at which the printing speed is changed from said normal-feed speed to said low-feed speed; and feed-speed change means, provided in said control circuit, for controlling said motor drive circuit to change the feed speed of said motor such that the dot printing speed corresponds to the normal speed at the start of printing, is changed from the normal speed to the low speed when said second detection means detects the second dot drive voltage during a normal-speed printing operation as a result of an increase in printing density of the dot elements, and is changed from the low speed to the normal speed when said first detection means detects the first dot drive voltage during a low printing operation as a result of a decrease in the printing density of the dot elements.

8. A print control apparatus according to claim 7, wherein said first and second dot drive voltages to be detected are variably set.

9. A print control apparatus according to claim 7, wherein said second detection means detects a lower print dot drive voltage than the predetermine level, said feed-speed change means selects a low speed mode determined by an upperlimit speed at full-dot printing depending on the limited current capacity for a sheet-feed speed and a dot-element drive speed, and if the dot drive voltage recovers to the predetermined level in a predetermined period, selects a high speed mode determined by an upper-limit speed of the print feed for the sheet feed speed and the dot-element drive speed.

* * * * *